US008245340B2

(12) United States Patent
Hsu

(10) Patent No.: US 8,245,340 B2
(45) Date of Patent: Aug. 21, 2012

(54) CHAIR STRUCTURE

(76) Inventor: Han-Chung Hsu, Taipei (TW)

( * ) Notice: Subject to any disclaimer, the term of this patent is extended or adjusted under 35 U.S.C. 154(b) by 52 days.

(21) Appl. No.: 13/028,305

(22) Filed: Feb. 16, 2011

(65) Prior Publication Data

US 2012/0056458 A1 Mar. 8, 2012

Related U.S. Application Data

(63) Continuation-in-part of application No. 12/877,275, filed on Sep. 8, 2010, now Pat. No. 7,934,277.

(51) Int. Cl.
*A47C 23/06* (2006.01)

(52) U.S. Cl. ..... 5/697; 5/936

(58) Field of Classification Search ..... 5/690, 697, 5/936, 727; 297/284.1, 284.3, 284.8, 452.28; 267/177, 170
See application file for complete search history.

(56) References Cited

U.S. PATENT DOCUMENTS

| | | | | |
|---|---|---|---|---|
| 3,081,129 | A * | 3/1963 | Ridder | 297/452.28 |
| 4,437,702 | A * | 3/1984 | Agosta | 297/284.8 |
| 6,209,380 | B1 * | 4/2001 | Papazian et al. | 72/413 |
| 6,721,981 | B1 * | 4/2004 | Greenhalgh et al. | 5/716 |
| 7,931,257 | B2 * | 4/2011 | VanDeRiet et al. | 267/142 |

* cited by examiner

*Primary Examiner* — Fredrick Conley
(74) *Attorney, Agent, or Firm* — Ming Chow; Sinorica, LLC

(57) ABSTRACT

A chair structure is a chair body with seat cushion and back cushion and comprises: a fixed plate, which has a plurality of flexible accommodating holes and at least one first flexible member; a moving plate, which has at least one second flexible member corresponding to the flexible accommodating hole, the moving plate is below the fixed plate and has a distance with the fixed plate for moving; at least one lifting device, which is combined with the bottom of the moving plate, the moving plate and the second flexible member move up and down via the lifting device in order to let that the second flexible member penetrates through the flexible accommodating holes and protrudes out of the top surface of the fixed plate.

11 Claims, 12 Drawing Sheets

CHAIR STRUCTURE

CROSS REFERENCE TO RELATED APPLICATION

This application is a Continuation-in-part of Ser. No. 12/877,275, filed Sep. 8, 2010 now U.S. Pat. No. 7,934,277, all of which is incorporated herein by reference.

BACKGROUND OF THE INVENTION

1. Field of the Invention

The present invention generally relates to a chair structure, more particularly to a chair structure that is adjustable in the field of support forces in order to provide different support forces for different users.

2. Description of the Prior Art

In generally, a chair structure is composed of a wooden structure covering with seat cushion and back cushion. The seat cushion and back cushion comprised springs or sponge pads in it. And they are wrapped up by fabric or leather, as well as the hand-rest.

Chair structure generally has fixed elasticity and shape, the softness of the seat cushion or back cushion was decided when it was made. Users cannot adjust the chair according to personal desires when they are using it. Users will feel uncomfortable if the cushions are not made by following the ergonomics.

Thereby, to develop a new type of chair structure is an issue for the skilled persons in the art and may be discussed hereinafter.

SUMMARY OF THE INVENTION

The main objective of the present invention is to provide a chair structure, wherein a moving plate can be adjusted for moving up and down so as to allow the total support force of the chair structure is adjustable for different users.

To reach above objective, the chair structure comprises: a chair body with seat cushion and back cushion; a fixed plate, which has a plurality of flexible accommodating holes and at least one first flexible member and is fixed in the seat cushion and back cushion, the flexible accommodating holes is at the bottom of the first flexible member; a moving plate, which has at least one second flexible member corresponding to the flexible accommodating hole, the second flexible member is able to move up and down via the internal of the first flexible member, the moving plate is below the fixed plate; and at least one lifting device, which allows the moving plate move up and down via the lifting device.

The lifting device moves the moving plate up to the fixed plate, the second flexible members then penetrate through the flexible accommodating holes. Meanwhile, not only the first flexible members are to support the user, but also the second flexible members do. Hence, the support forces are enhanced; otherwise, to activate the lifting device and the motor is to lower down the moving plate, then the second flexible members are lowered down either so as to make that only the first flexible members support the user. That is, the support forces are decreased.

Preferably, the flexible accommodating holes are not only disposed at the bottom of the first flexible members, but also disposed between two first flexible members. So that when the second flexible members move up through the moving plate, the support forces of the chair structure are still controllable due to that each flexible accommodating hole is between two first flexible members.

Preferably, the lifting devices are disposed at the four corners of the moving plate.

Preferably, the lifting devices are disposed at the central portion of the moving plate.

Preferably, the lifting device includes a motor and a power-output axis disposed at the motor and connected with the moving plate.

Preferably, the power-output axis of the lifting device is a ball screw rod.

Preferably, the first flexible member and the second flexible member adopt a cell arrangement.

Preferably, the first flexible member and the second flexible member adopt a parallel arrangement.

Preferably, the first flexible member and the second flexible member adopt a regulated and staggered arrangement.

Preferably, the lifting device is connected with a remote receiver and a remote radiator, the remote radiator is capable of radiating signals to the remote receiver for a user controlling the lifting device.

Preferably, a gap between the first flexible member and the second flexible member is disposed a guiding member.

Preferably, the lifting device includes a air compressor and air bags disposed below the moving plate, wherein the air bags are connected with the air compressor through at least one tube in order to let the air bags be inflated by the air compressor to move the moving plate and the second flexible members up and down.

Preferably, a support plate is disposed under the moving plate and the air compressor is disposed at the support plate, and the air bag is disposed between the moving plate and the support plate.

Preferably a plurality of positioning pillars are disposed on the support plate, the positioning pillars are penetrated through the moving plate so as to let the moving plate steadily move up and down.

Preferably a height sensor is disposed between the moving plate and the support plate and connected with the air compressor, the distance data between the moving plate and the support plate is transmitted to the air compressor so as to control the displacement of the moving plate.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
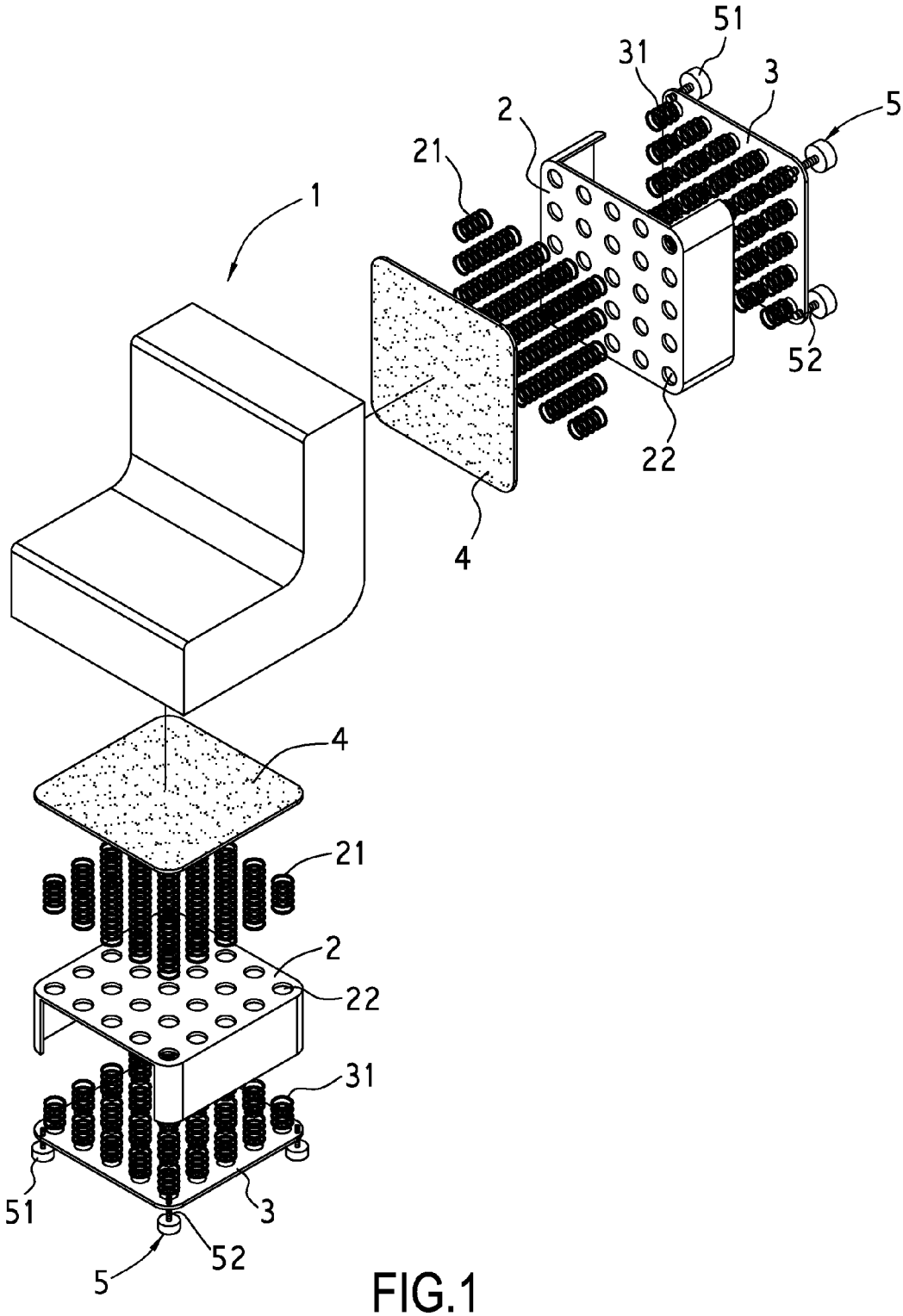
FIG. 1 illustrates a schematic 3-D exploded view of a chair structure of the present invention.
Figure 2:
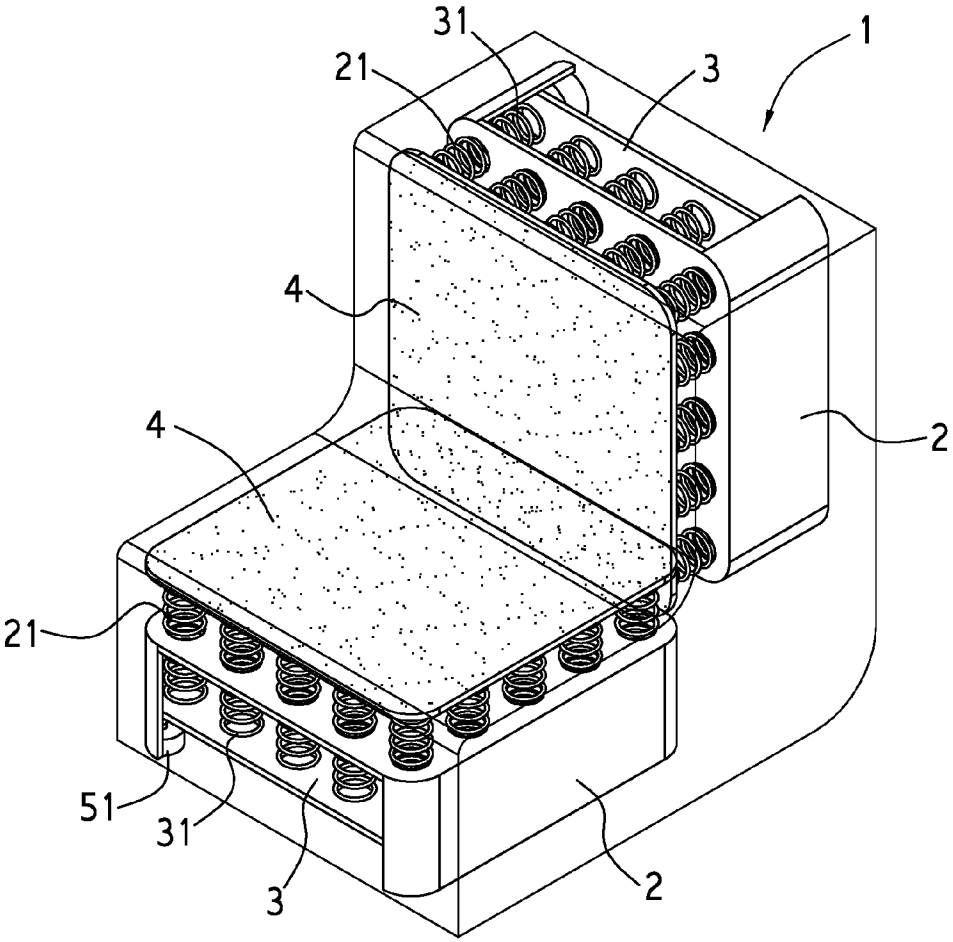
FIG. 2 illustrates a schematic 3-D assembled view of the chair structure of the present invention.
Figure 3:
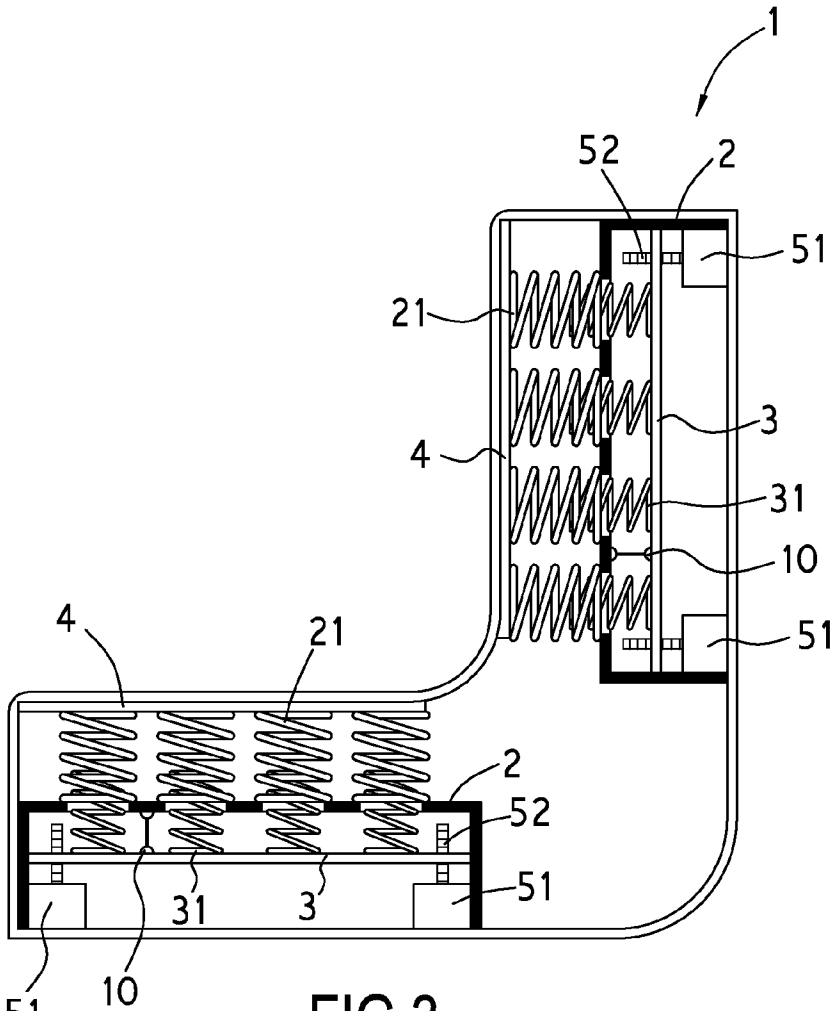
FIG. 3 illustrates a schematic action sectional view of the chair structure of the present invention.

With references to FIG. 1 to FIG. 3, which illustrate a schematic 3-D exploded view of a chair structure of the present invention, a schematic 3-D assembled view of the chair structure of the present invention and a schematic action sectional view of the chair structure of the present invention. The chair structure is a chair body 1 with a seat cushion and a back cushion, which includes:

a fixed plate 2, which is disposed in the seat cushion and back cushion and has a plurality of flexible accommodating holes 22, the outer rim of the top surface of each flexible accommodating hole 22 is combined with a first flexible member 21, the flexible accommodating hole 22 is corresponding to the space of the first flexible member 21;

a moving plate 3, which has a plurality of second flexible members 31 corresponding to the flexible accommodating holes 22 of the fixed plate 2, the moving plate 3 is below the fixed plate 2, the second flexible member 31 is able to move upwardly from the internal of first flexible member 21;

four lifting devices 5, which is combined with the bottom of the moving plate 3, in the preferred embodiment, the four lifting devices 5 are disposed at the four corners of the bottom of the moving plate 3, but the positions for the lifting devices 5 are not limited by the preferred embodiment, another example is the central portion of the moving plate 3, each lifting device 5 includes a motor 51 and a power-output axis 52 disposed at the motor 51 and connected with the moving plate 3, the power-output axis 52 is a ball screw rod, while the motor 51 rotates, the moving plate 3 moves up and down through the power-output axis 52, further, the lifting device 5 can be connected with a remote control device (not shown in the figure), which has a remote receiver and a remote radiator (not shown in the figure), the remote receiver is electrically connected with the motor 51 and receives the signals from the remote radiator so as to control the motor 51, the remote radiator is capable of radiating the signals of activation, lifting and lowering to the remote receiver for a user controlling the lifting device 5; further, a height sensor 10 is disposed between the moving plate 3 and the fixed plate 2, which is electrically connected to the motor 51; the distance data between the moving plate 3 and the fixed plate 2 is transmitted to the motor 51 so as to control the displacement; a flexible layer 4, which is disposed on the surface of the first flexible member 21.

Above preferred embodiment of controlling the lifting device 5 by means of the remote control device is not to limit the scope of the present invention, other ways of manual or auto control may be included in the present invention.

Figure 4:
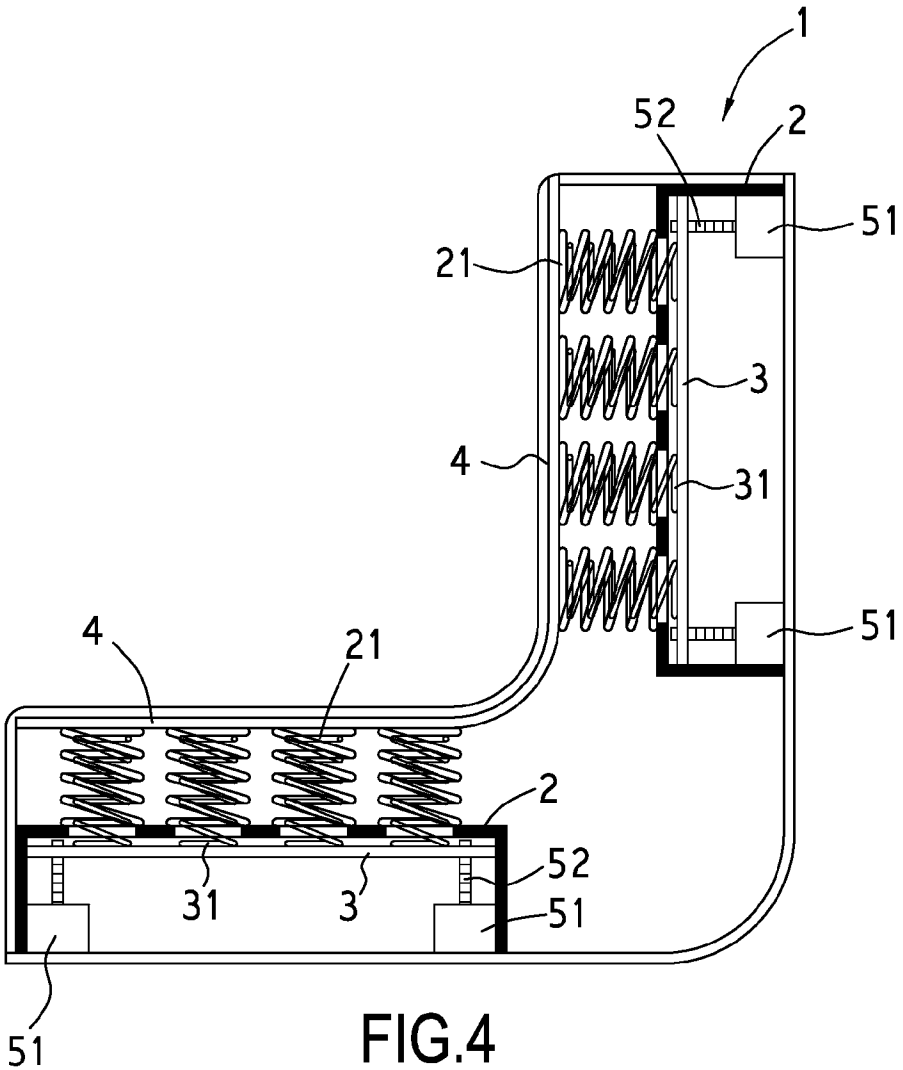
FIG. 4 illustrates a schematic sectional action view of a second flexible member of the chair structure of the present invention.
Figure 5:
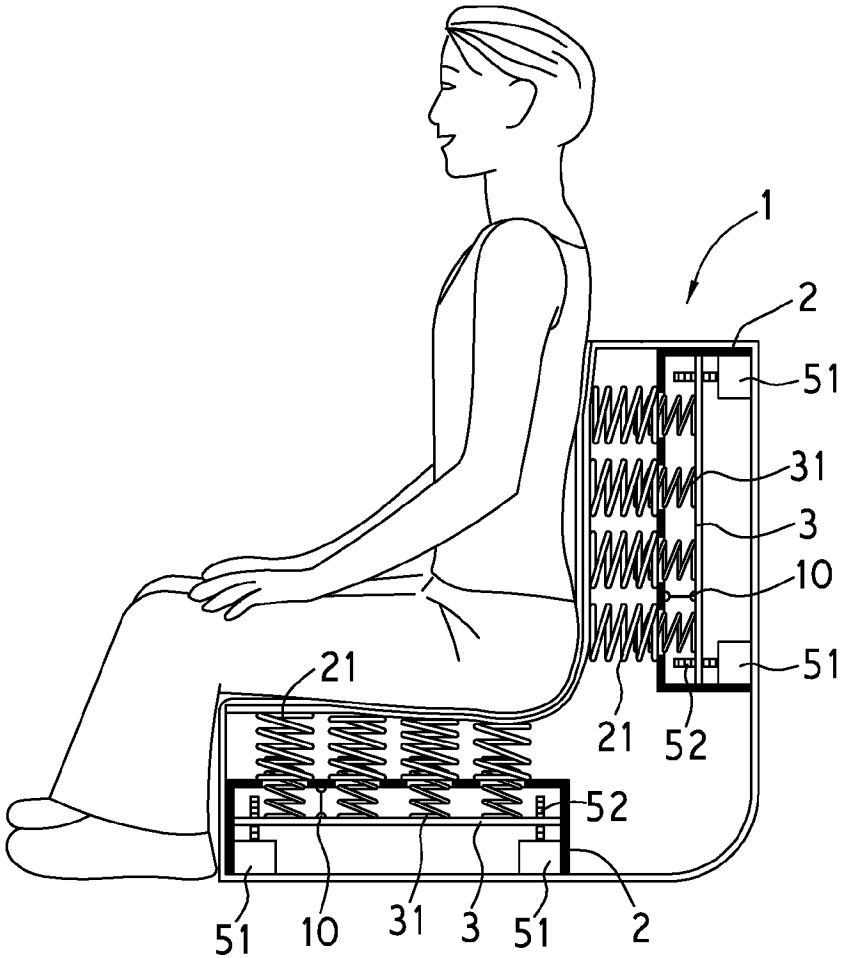
FIG. 5 illustrates a schematic sectional application view of the second flexible member of the chair structure of the present invention.

With references to FIG. 4 and FIG. 5, which illustrate a schematic sectional action view of the second flexible member of the chair structure of the present invention and a schematic sectional application view of the second flexible member of the mattress structure of the present invention. While the user demands that the support forces of the seat cushion or the back cushion are promoted, to activate the motors 51 and then to drive the power-output axes 52 are to move the moving plate 3 up to the fixed plate 2, the second flexible members 31 go through the flexible accommodating holes 22. Meanwhile, not only the first flexible members 21 are to support the user, but also the second flexible members 31 do. Hence, the support forces are enhanced; otherwise, to activate the lifting device 5 and the motor 51 is to lower down the moving plate 3, then the second flexible members 31 are lowered down either so as to make that only the first flexible members 21 support the user. That is, the support forces are decreased.

The distance for the moving plate 3 moving upward can be controlled by the user. The second flexible members 31 of the moving plate 3 can be moved up to ⅓, ½ or ⅔ height of the first flexible member 21 or the equal height or any height of the first flexible member 21. Therefore, the first flexible member 21 may have different lowering depths and different support forces while being compressed by the user.

Figure 6:
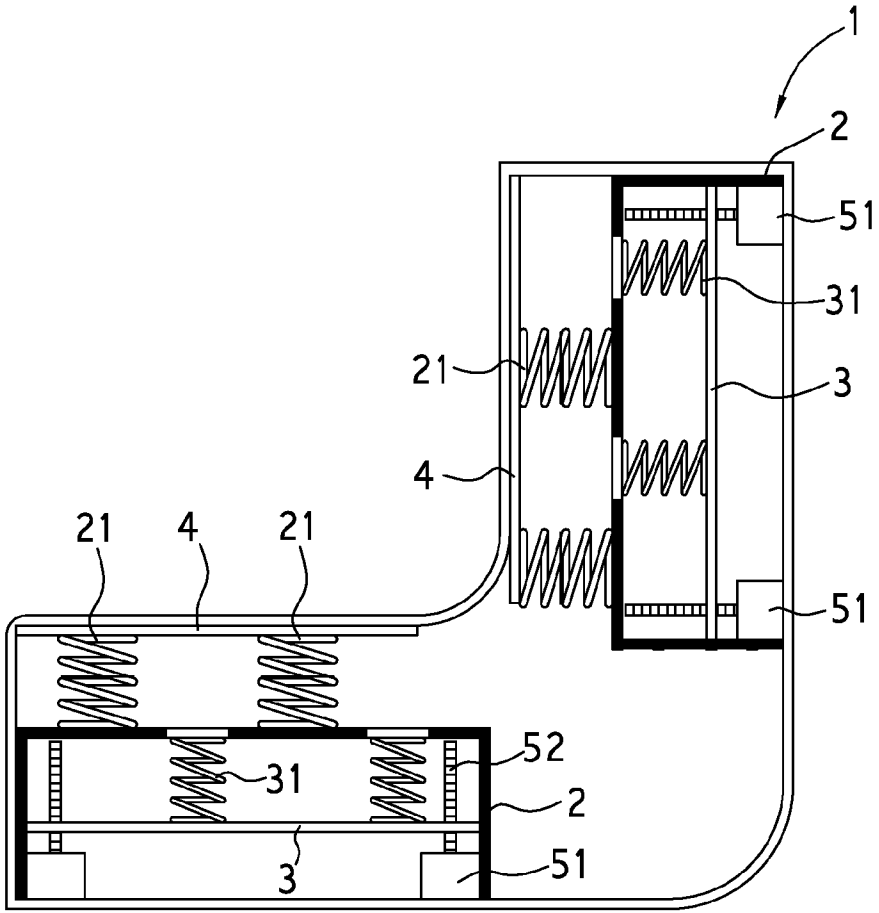
FIG. 6 illustrates a schematic sectional structural view of another preferred embodiment of the chair structure of the present invention.

With reference to FIG. 6, which illustrates a schematic sectional structural view of another preferred embodiment of the chair structure of the present invention. In the preferred embodiment, the flexible accommodating holes 22 of the fixed plate 2 are corresponding to the spaces of the first flexible members 21, or each flexible accommodating hole 22 is disposed between two first flexible members 21. In other words, the second flexible members 31 are staggered between two first flexible members 21. While the user demands that the support forces of the chair are promoted, to activate the motors 51 and then to drive the power-output axes 52 are to move the moving plate 3 up to the fixed plate 2, the second flexible members 31 go through the flexible accommodating holes 22 and are disposed among the first flexible members 21. Meanwhile, not only the first flexible members 21 are to support the user, but also the second flexible members 31 do. Hence, the support forces are enhanced; otherwise, to activate the lifting device 5 and the motor 51 is to lower down the moving plate 3, then the second flexible members 31 are lowered down either so as to make that only the first flexible members 21 support the user. That is, the support forces are decreased.

Figure 7A:
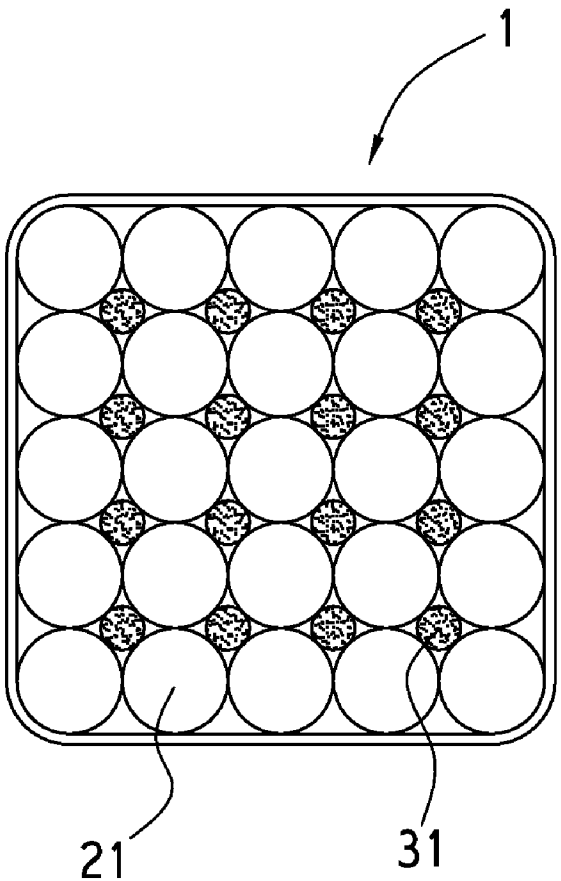
FIG. 7A illustrates a schematic arrangement view of a first surface of a first flexible member and the second flexible member of the chair structure of the present invention.
Figure 7B:
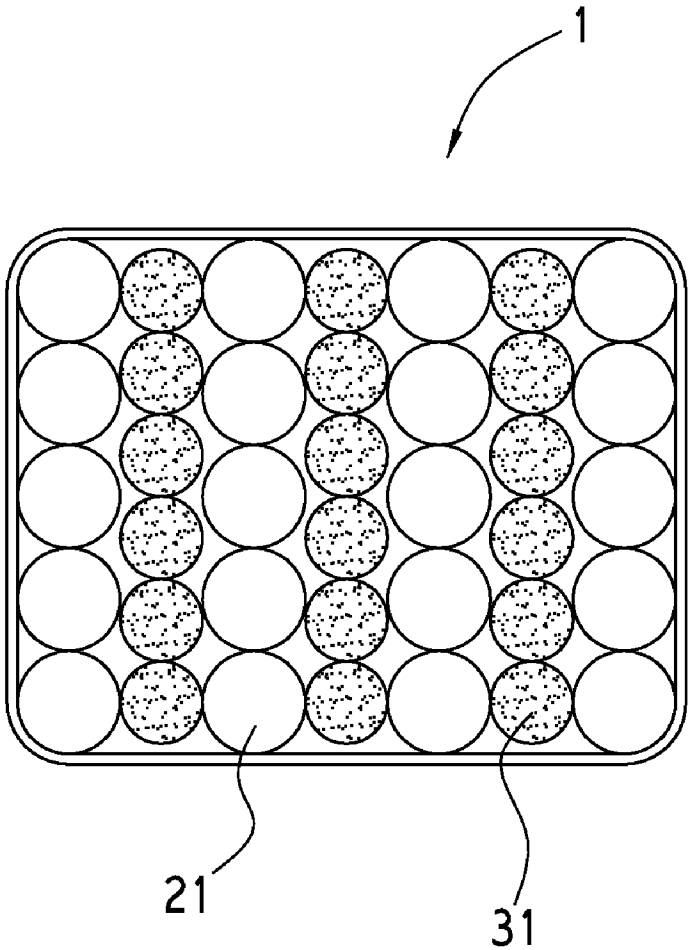
FIG. 7B illustrates a schematic arrangement view of a second surface of the first flexible members and the second flexible members of the chair structure of the present invention.
Figure 7C:
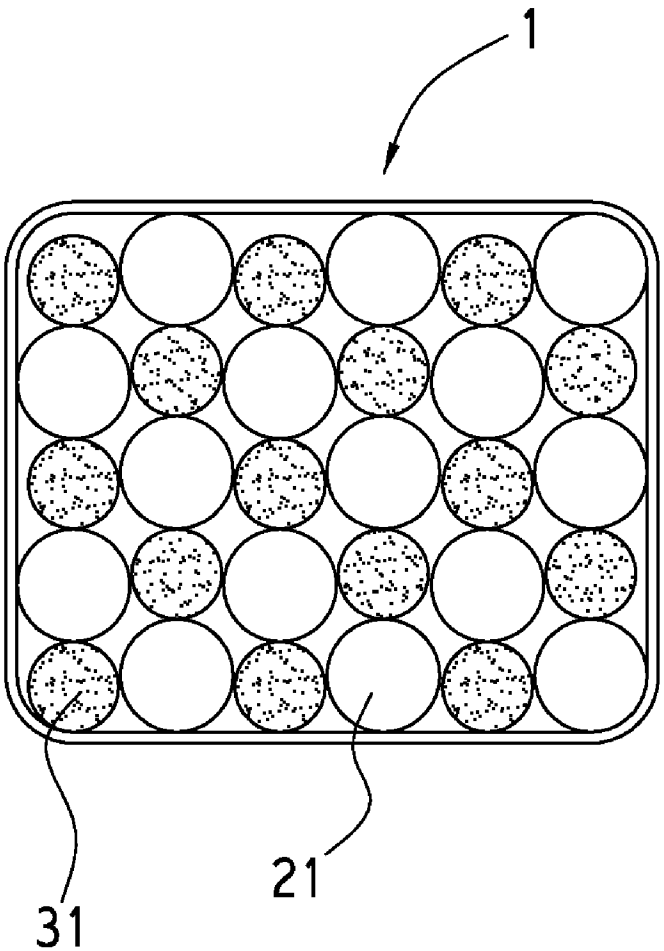
FIG. 7C illustrates a schematic arrangement view of a third surface of the first flexible member and the second flexible member of the chair structure of the present invention.

With references to FIG. 7A, FIG. 7B and FIG. 7C, which illustrate a schematic arrangement view of a first surface of the first flexible member and the second flexible member of the chair structure of the present invention, a schematic arrangement view of a second surface of the first flexible members and the second flexible members of the chair structure of the present invention and a schematic arrangement view of a third surface of the first flexible member and the second flexible member of the chair structure of the present invention. The three figures present the arrangements of the first flexible members and the second flexible members disposed on the seat cushion or the back cushion respectively. FIG. 7A presents that the first flexible members 21 and the second flexible members 31 adopt a cell arrangement, that is, the arrangement for the first flexible members 21 and the second flexible members 31 is close and intersected, such as a cell. FIG. 7B presents that the first flexible members 21 and the second flexible members 31 adopt a parallel arrangement. FIG. 7C presents that the first flexible members 21 and the second flexible members 31 adopt a regulated and staggered arrangement, that is, the arrangement defines that the first flexible members 21 and the second flexible members 31 are parallel to each other, but the positions for the first flexible members 21 and the positions for the second flexible members 31 are staggered with each other. Anyhow, no matter what the arrangement for the first flexible members 21 and the second flexible members 31 is one of above three arrangements, the function to adjust the support forces of the chair structure can be reached.

Figure 8:
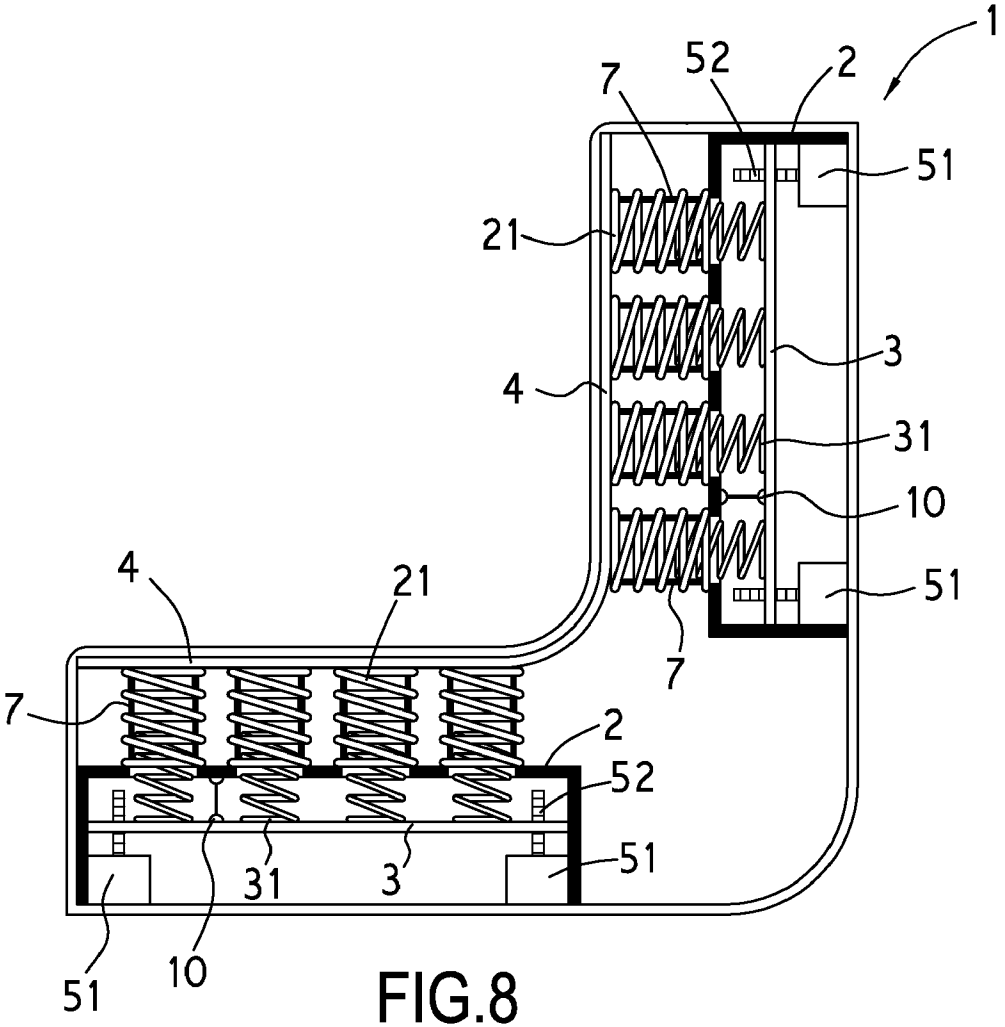
FIG. 8 illustrates a schematic sectional structural view of another preferred embodiment of the chair structure of the present invention.

With reference to FIG. 8, which illustrates a schematic sectional structural view of another preferred embodiment of the chair structure of the present invention. In the preferred embodiment, a guiding member 7 is disposed in a gap between the first flexible member 21 and the second flexible member 31 so as to avoid that an impact of the first flexible member 21 and the second flexible member 31 causes deformations for the first flexible member 21 and the second flexible member 31 due to angle deviations while the second flexible member 31 moves up to the first flexible member 21. Hence, the guiding member 7 guides the moving direction of the second flexible member 31 in order to avoid the deformations of the first flexible member 21 and the second flexible member 31. Further, the guiding member 7 is made of foam.

Figure 9:
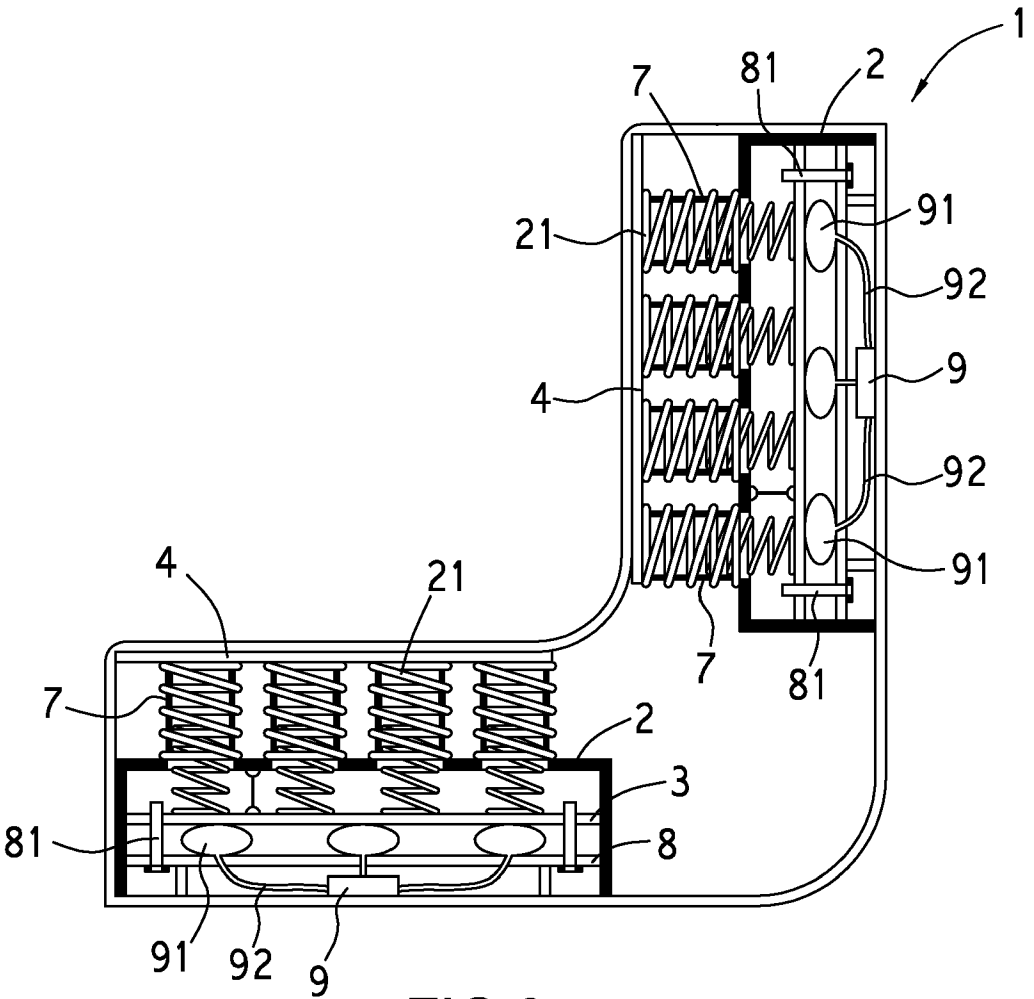
FIG. 9 illustrates a schematic sectional structural view of a preferred embodiment of a lifting device of the chair structure of the present invention.

With reference to FIG. 9, which illustrates a schematic sectional structural view of a preferred embodiment of the lifting device of the chair structure of the present invention. In the preferred embodiment, a support plate 8 is disposed under the moving plate 3; the air compressor 9 is under the support plate 8, the air bags 91 are between the moving plate 3 and the support plate 8, the air bags 91 are connected with the air compressor 9 through the tubes 92 in order to let the air bags 91 be inflated by the air compressor 9; a plurality of positioning pillars 81 are disposed on the support plate 8, the positioning pillars 81 are penetrated through the moving plate 3 so as to let the moving plate 3 steadily move up and down. Besides, a height sensor 10 is disposed between the moving plate 3 and the support plate 8 and connected with the air compressor 9, the distance data between the moving plate 3 and the support plate 8 is transmitted to the air compressor 9 so as to control the displacement of the moving plate 3.

While the user demands that the support forces of the chair are promoted, the air compressor 9 inflates the air bags 91, the moving plate 3 moves up and toward the fixed plate 2. The second flexible member 31 on the moving plate 3 then goes through the flexible accommodating holes 22. Meanwhile, not only the first flexible members 21 are to support the user, but also the second flexible members 31 do. Hence, the support forces are enhanced; otherwise, to leak the air in the air bags through the air compressors 9 is to lower down the moving plate 3, then the second flexible members 31 are lowered down either so as to make that only the first flexible members 21 support the user. That is, the support forces are decreased.

Figure 10:
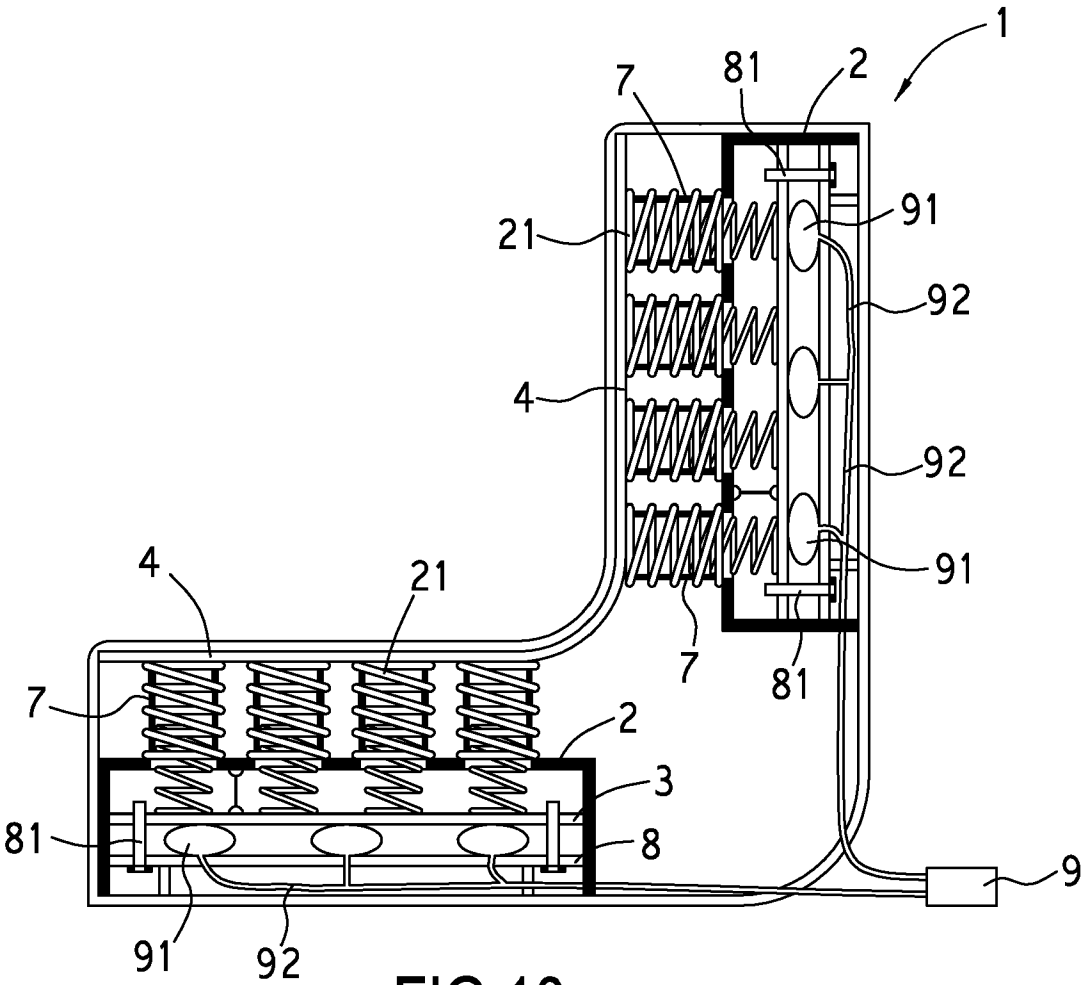
FIG. 10 illustrates a schematic sectional structural view of another preferred embodiment of the lifting device of the chair structure of the present invention.

With reference to FIG. 10, which illustrates a schematic sectional structural view of another preferred embodiment of the lifting device of the chair structure of the present invention. The preferred embodiment is the mostly like the preferred embodiment in FIG. 9 in the aspect of structure, and it may not be described any further hereinafter. The difference is to dispose the air compressor 9 outside the chair, and the air compressor 9 is connected with the air bags 91 after the air bags 91 are connected with each other through the tubes 92. By means of the outside air compressor 9, the height of the chair is lowered down for decreasing an occupied volume.

The preferred embodiments of the lifting devices 5 and 9 as the motor 51 and the air bags 91 are not to limit the scope of the present invention. Thus, any device to move the moving plate 3 up and down may be in the field of the present invention.

The lifting device 51 and 91 can be controlled to move the moving plate 3 up and down through a manual mode, not only an automatic mode.

The moving plate 3 can be moved automatically and as a massage chair.

With the comparison to the prior art, the present invention has an advantage, that is, the moving plate can be adjusted for moving up and down so as to let the support forces of the firs flexible member 21 be integrated with the support forces of the second flexible member 31 of the moving plate 3. Hence, the total support force of the chair structure is adjustable for different users. So that the lowering distance of the chair structure is controllable.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. A chair structure, which is a chair body 1 with seat cushion and back cushion, comprising:

a fixed plate, which has a plurality of flexible accommodating holes and at least one first flexible member;

a moving plate, which has at least one second flexible member corresponding to the flexible accommodating hole, the moving plate being below the fixed plate and having a distance with the fixed plate for moving;

at least one lifting device, which is combined with the bottom of the moving plate, the moving plate and the second flexible member moving up and down via the lifting device in order to let that the second flexible member penetrates through the flexible accommodating holes and protrudes out of the top surface of the fixed plate.

2. The chair structure according to claim 1, further comprising a remote control device, which is connected with the lifting device 5 for controlling the lifting device 5.

3. The chair structure according to claim 1, wherein the lifting device comprises a motor and a power-output axis disposed at the motor and connected with the moving plate.

4. The chair structure according to claim 1, wherein the flexible accommodating holes are disposed at the bottom in the first flexible member.

5. The chair structure according to claim 1, wherein the flexible accommodating holes are disposed between the two first flexible members.

6. The chair structure according to claim 1, wherein the first flexible member and the second flexible member adopt a cell arrangement.

7. The chair structure according to claim 1, wherein a height sensor is disposed between the fixed plate and the moving plate and the height sensor is electrically connected to the lifting device.

8. The chair structure according to claim 1, wherein the lifting device comprising an air compressor and air bags, which being under the support plate, the air bags being connected with the air compressor through the tube in order to let the air bags be inflated by the air compressor, so that the moving plate and the second flexible member are driven by the air bag for moving up and down, the second flexible member then going through the flexible accommodating holes and protruding out from the surface of the fixed plate.

9. The chair structure according to claim 8, wherein a support plate is disposed under the moving plate and the air compressor is disposed in the support plate while the air bags are disposed between the moving plate and the support plate.

10. The chair structure according to claim 8, wherein a plurality of positioning pillars are disposed on the support plate, the positioning pillars 81 being penetrated through the moving plate so as to let the moving plate 3 steadily move up and down.

11. The chair structure according to claim 8, wherein a height sensor 10 is disposed between the moving plate 3 and the support plate 8 and connected with the air compressor 9, the distance data between the moving plate 3 and the support plate 8 is transmitted to the air compressor 9 so as to control the displacement of the moving plate 3.

* * * * *